US008156878B2

(12) United States Patent
Lazar et al.

(10) Patent No.: US 8,156,878 B2
(45) Date of Patent: Apr. 17, 2012

(54) PUMP POCKET

(76) Inventors: Ann Patricia Lazar, Lafayette, NJ (US); Marie Patricia Bloxham, Andover, NJ (US)

( * ) Notice: Subject to any disclaimer, the term of this patent is extended or adjusted under 35 U.S.C. 154(b) by 24 days.

(21) Appl. No.: 12/496,521

(22) Filed: Sep. 18, 2009

(65) Prior Publication Data

US 2011/0030598 A1 Feb. 10, 2011

Related U.S. Application Data

(60) Provisional application No. 61/077,680, filed on Jul. 2, 2008.

(51) Int. Cl.
*D05B 23/00* (2006.01)

(52) U.S. Cl. ..... 112/475.09

(58) Field of Classification Search ..... 2/247, 249–254, 2/69, 94, 108, 115, 227, 228, 102; 112/475.01, 112/475.09, 475.13, 475.07, 147, 152
See application file for complete search history.

(56) References Cited

U.S. PATENT DOCUMENTS

| | | | | |
|---|---|---|---|---|
| 709,460 | A * | 9/1902 | Bartell | 2/248 |
| 3,451,065 | A * | 6/1969 | Augustin | 2/247 |
| 3,602,914 | A * | 9/1971 | Castello | 2/90 |
| 4,040,275 | A * | 8/1977 | Castello | 66/64 |
| 4,062,064 | A * | 12/1977 | Vosatka | 2/252 |
| 4,825,471 | A * | 5/1989 | Jennings | 2/94 |
| 4,876,724 | A * | 10/1989 | Suzuki | 381/385 |
| 5,823,128 | A * | 10/1998 | Lapidus | 112/475.06 |
| 6,477,710 | B1 * | 11/2002 | Ojoyeyi | 2/69 |
| 6,691,323 | B2 * | 2/2004 | Widmer | 2/247 |
| 6,810,529 | B1 * | 11/2004 | Reilly et al. | 2/69 |
| 6,826,782 | B2 * | 12/2004 | Jordan | 2/94 |
| 7,051,373 | B1 * | 5/2006 | Krall | 2/69 |

* cited by examiner

*Primary Examiner* — Tejash Patel

(57) ABSTRACT

A dual access pocket for supporting and/or storing medical devices such as insulin pumps and portable defibrillation devices and methods of manufacturing a garment including same. The garment into which the dual access pocket is sewn includes one or more front panel or panels, each of which have an outside surface and an inside surface. The dual access pocket has one or two openings secured on the inside surface of the front panel of the garment, wherein one of said openings is located internal to said front panel of the garment and one of said openings is in communication with a slit through the front panel to provide external access to said dual access pocket. The dual access pocket is therefore accessible from the inside of the garment and the outside of the garment.

9 Claims, 3 Drawing Sheets

PUMP POCKET

CROSS-REFERENCE TO RELATED APPLICATIONS

This application claims the benefit of the U.S. provisional patent application having Ser. No. 61/077,680, filed Jul. 2, 2008, entitled "The Pump Pocket", which is incorporated herein by reference in its entirety as if fully set forth herein.

BACKGROUND OF THE INVENTION

Embodiments of the present invention generally relate to dual access pockets and methods of manufacturing same. More specifically, the present invention relates to dual access pockets capable of supporting medical devices such as insulin pumps and methods of manufacturing same.

An insulin pump is an excellent tool to utilize in the effective management of diabetes. In one form, insulin pumps are small computerized devices approximately 5 inches in length 3 inches in diameter, and 2½ inches in height, that hold a cartridge filled with insulin therein. A length of tubing runs from the insulin pump and is connected to the body of a wearer of the insulin pump, and insulin is pumped from the computerized device through the tubing and into the body as needed.

In order to achieve maximum results, the insulin pump should be continuously connected to the body. Continuous connection to the body can be problematic at times and, at the very least, can be inconvenient particularly during active endeavors and when reclining or sleeping. Additionally, when carried on the manufacturer supplied clip, the insulin pump can be knocked off the body of the wearer. Or, if carried in a pocket, the insulin pump can fall out. Also problematic is exposure of the length of tubing. The tubing can get caught on things like door knobs, furniture, or other things a person comes in contact with on a daily basis. This can cause the tubing to be pulled on and may cause unintended disconnection of the insulin pump from the body, thereby interrupting the delivery of insulin.

It is in regard to these issues and others that the present invention is directed.

BRIEF SUMMARY OF THE INVENTION

Briefly stated, in one aspect of the present invention, a method of manufacturing a garment including a dual access pocket, the garment having a front garment panel, the front garment panel including an inside surface and an outside surface. This method is comprised of the following steps: providing a pair of pocket panels; sewing the pair of pocket panels to each other to form a pocket with a plurality of openings; sewing the pocket to the inside surface of the front garment panel in areas other than the plurality of openings such that the plurality of openings remain intact; sewing a closure into inside of the plurality of openings of the pocket; and cutting a slit in the front garment panel in location of a first of the one or more openings to provide access to the pocket through the first of the one or more openings from the outside surface of the front garment panel; wherein the pocket is attached to the inner surface; wherein the pocket includes interior access through a second of the plurality of openings; and wherein the pocket communicates with the slit to provide access to the pocket from an outside surface of the front garment panel.

BRIEF DESCRIPTION OF THE SEVERAL VIEWS OF THE DRAWINGS

The nature and various advantages of the present invention will become more apparent upon consideration of the following detailed description, when taken in connection with the accompanying drawings in which.

DETAILED DESCRIPTION OF THE INVENTION

Generally, the present invention provides a dual access pocket, which is attached to a front panel or panels of a garment to provide a means of storing, carrying, and utilizing an insulin pump in a convenient, comfortable, secure and discreet manner. The invention can be incorporated into most articles of clothing including, but not limited to: pants, shorts, dresses, shirts, skirts, pajamas, sweaters, jackets, and undergarments.

Another object of the invention is that it allows access to the dual access pocket in two ways. It can be accessed through a rear opening on the interior side of a garment and can be accessed from a side or front opening on the external side of the garment.

Another object of the invention is that it provides for the insulin pump to be inserted into the dual access pocket from the internal side of the garment and the tubing can be tucked into the pocket and kept close to the body. The internal opening is secured by a Velcro® hook and loop material closure with space on either side to allow the tubing to move freely while dressing or undressing.

Another object of the invention is that access to the pump throughout the day for various reasons or throughout the night (e.g., when checking blood sugar levels, administering insulin to correct blood sugar levels, etc.) is simplified with access through a front or side opening on the external side of the garment.

Another object of the invention is that it can also accommodate a portable defibrillation device.

As used herein, the term "rear opening" refers to a pocket opening on the internal side of a garment. The terms "left opening", "right opening" and "front opening" refer to pocket openings on the external side of the garment.

Figure 1:
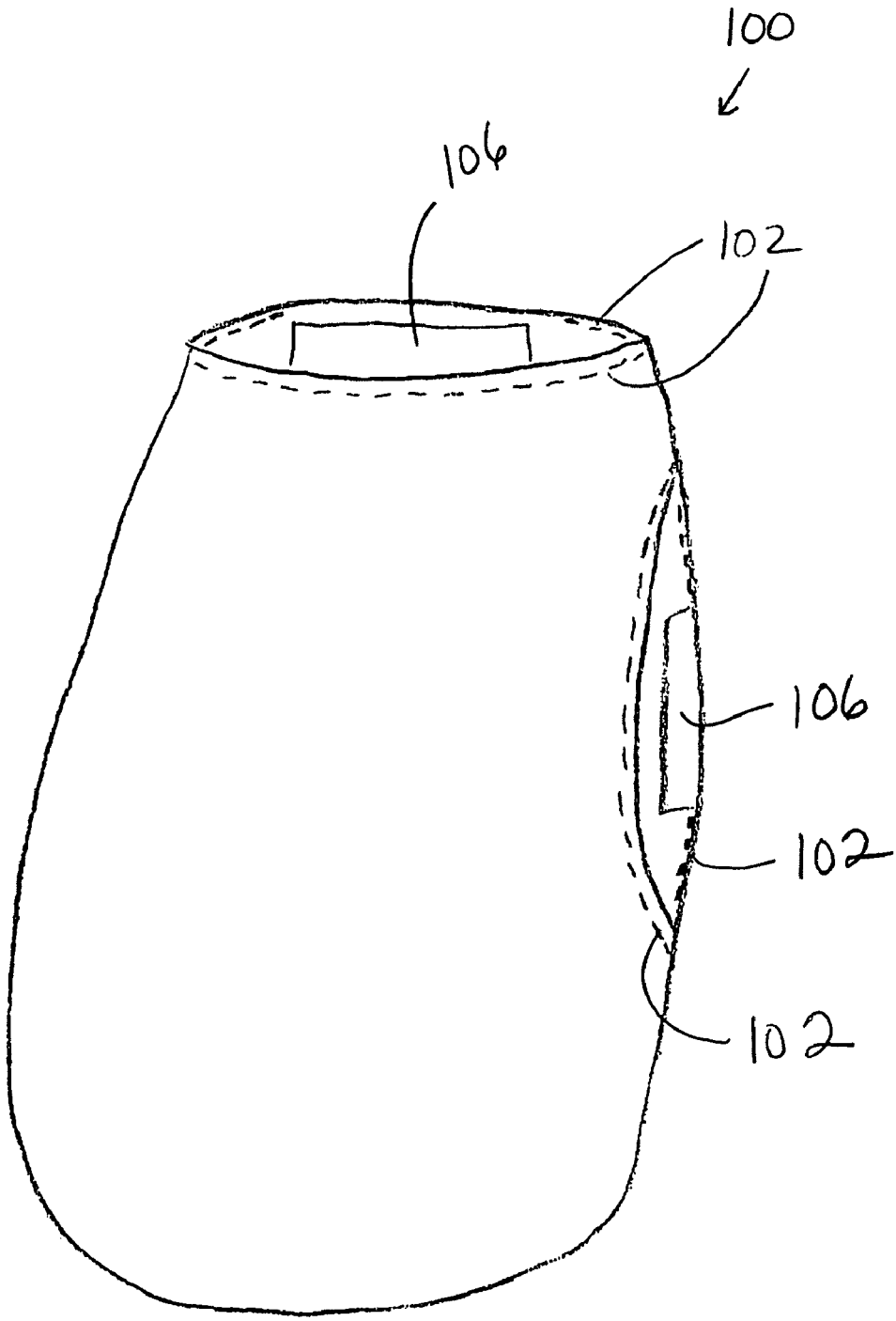
FIG. 1 depicts a front view of a dual access pocket with rear and right side openings in accordance with one embodiment of the present invention.

FIG. 1 depicts a dual access pocket 100 approximately six inches in width and nine inches in length. Dashed lines 102 depict connection points to attach dual access pocket 100 to the internal side of a garment with a four inch wide opening to create internal access to the pocket. Dashed lines 102 also depict connection points to attach a 30 six inch high opening along the right side of dual access pocket 100 for attachment to the internal side of a garment to create a side opening accessible from the external side of a garment. Velcro® hook and loop material closures 106 are depicted as well.

Figure 2:
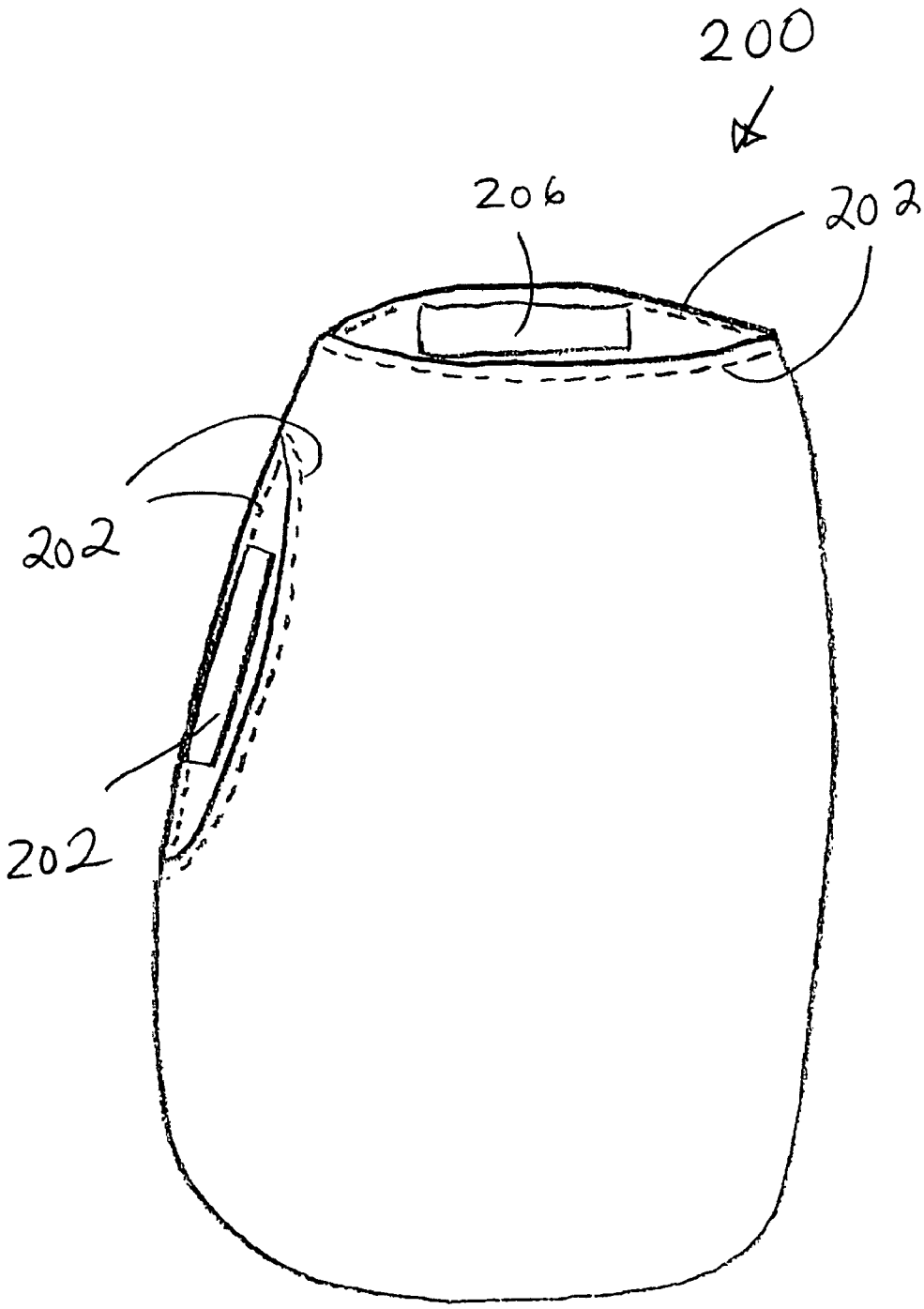
FIG. 2 depicts a front view of a dual access pocket with rear and left side openings in accordance with an alternate embodiment of the present invention.

As in FIG. 1, FIG. 2 depicts a dual access pocket 200 with approximately the same dimensions and with the same indicators of connection points 202 (comparable to connection points 102) for attachment of dual access pocket 200 to the interior and exterior of a garment and with Velcro® hook and loop material closures 206 (comparable to Velcro® hook and loop material closures 106). However, it depicts a left side external opening rather than a right side external opening.

Figure 3:
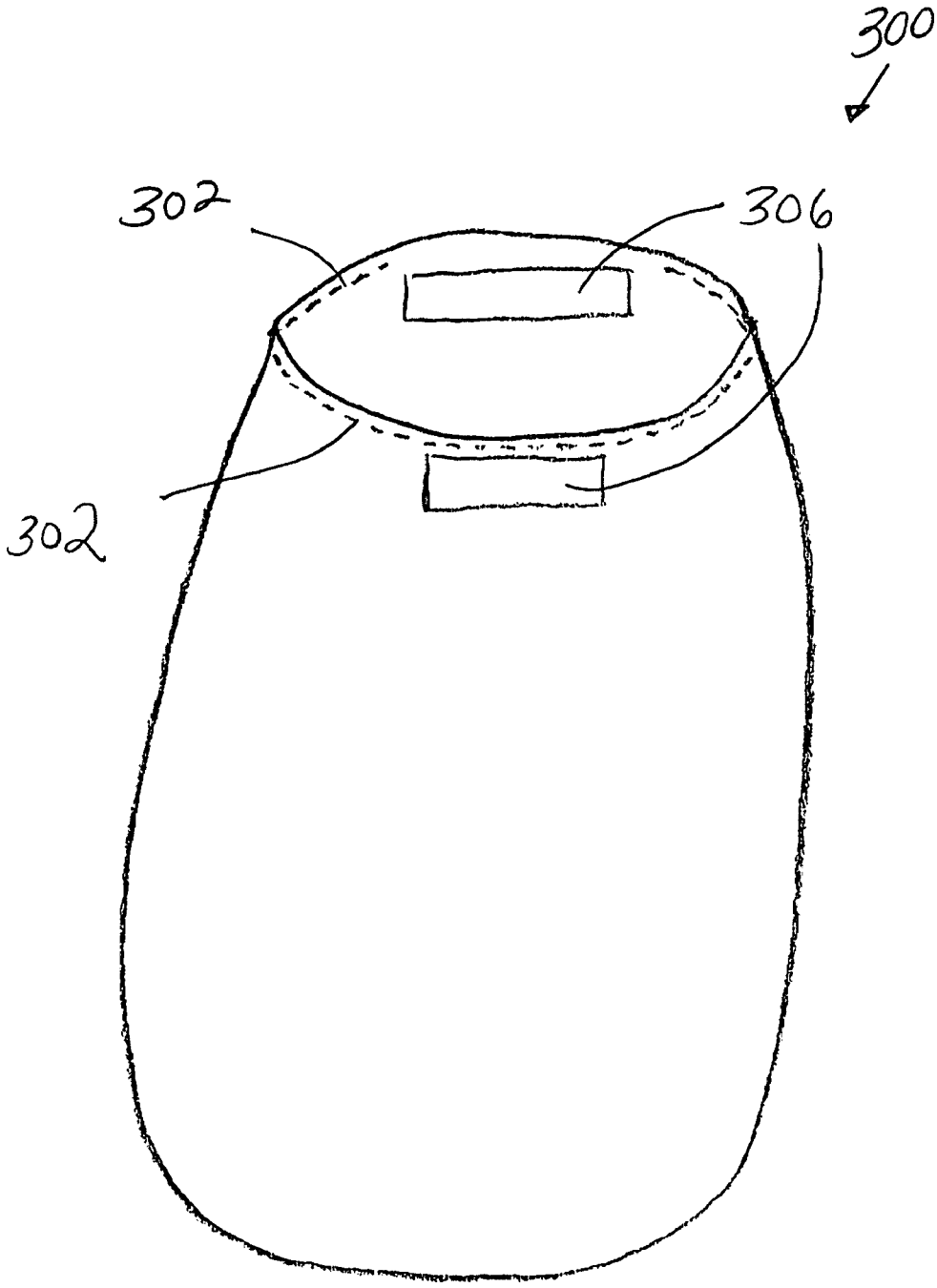
FIG. 3 depicts a dual access pocket with rear and front openings in accordance with yet another embodiment of the present invention.

As in FIG. 1 and FIG. 2, FIG. 3 depicts a dual access pocket 300 with approximately the same dimensions and indicators of connection points 302 (comparable to connection points 102) with Velcro® hook and loop material closures 306 (comparable to Velcro® hook and loop material closures 106) but depicting the external access to the pocket in the front of the pocket.

Disclosed is a method of manufacturing a garment comprising a garment having a front panel or panels including inside and outside surfaces, the method including the steps of: providing a pair of panels, sewing said pair of panels together to form a pocket, sewing said pocket into the interior side of a garment leaving a four inch opening unattached at the top of said pocket, on the side worn closest to the body, sewing Velcro® hook and loop material into the inside top of said pocket to create closure, cutting a slit in the exterior side of said garment, said interior pocket attached to said inner surface of said garment and including an interior access opening thereto, said interior pocket communicating with said slit such that said interior pocket is accessible from both interior and exterior surfaces of said garment, and sewing a Velcro® hook and loop material closure inside said external pocket opening.

While the above detailed description describes the preferred embodiment of the present invention, the invention is susceptible to modification and variation with regard to garment fabric, dimension and closure type without changing the teachings of the invention.

We claim:

1. A method of manufacturing a garment including a dual access pocket, said garment having a front garment panel, said front garment panel including an inside surface and an outside surface comprising the steps of:

providing two pocket panels;

sewing said two pocket panels to each other to form a pocket, said pocket including a first opening and a second opening;

sewing said pocket to said inside surface of said front garment panel such that said first opening and said second opening remain intact;

sewing at least one closure into an inside of said pocket; and cutting a slit in said front garment panel in a location of said first opening to provide access to said pocket through said first opening from outside said front garment panel;

wherein said pocket is attached to said inside surface;

wherein said first opening communicates with said slit to provide access to said pocket from outside said front garment panel; and wherein said second opening provides access to said pocket from inside said front garment panel.

2. A method according to claim 1 further comprising the step of:

inserting at least one of the group consisting of an insulin pump and a defibrillation device into said pocket through said second opening.

3. A method according to claim 2 further comprising the step of:

tucking tubing associated with said at least one of the group consisting of an insulin pump and a defibrillation device into said pocket.

4. A method according to claim 1, wherein said at least one closure is a hook and loop material.

5. A method according to claim 1, wherein said closure includes space on at least one side of said closure.

6. A method according to claim 1 further comprising the steps of:

inserting one of the group consisting of an insulin pump and a defibrillation device into said pocket through said second opening; and passing tubing associated with said one of the group consisting of an insulin pump and a defibrillation device through a space located adjacent said at least one closure.

7. A method according to claim 6 further comprising:

tucking said tubing of said one of the group consisting of an insulin pump and a defibrillation device into said pocket.

8. A method according to claim 1, wherein said first opening is one of the group consisting of a right side opening, a left side opening, and a front opening; and wherein said second opening is a rear opening.

9. A method according to claim 1, wherein said pocket is approximately six inches wide and approximately nine inches long; and wherein said slit is approximately four inches wide.

* * * * *